US009016488B1

(12) United States Patent
Peres

(10) Patent No.: US 9,016,488 B1
(45) Date of Patent: Apr. 28, 2015

(54) COMPARTMENTALIZED MIXING BOTTLE AND ASSOCIATED USE THEREFORE

(76) Inventor: Travis Peres, Palm Bay, FL (US)

( * ) Notice: Subject to any disclaimer, the term of this patent is extended or adjusted under 35 U.S.C. 154(b) by 212 days.

(21) Appl. No.: 13/402,649

(22) Filed: Feb. 22, 2012

Related U.S. Application Data

(63) Continuation-in-part of application No. 12/381,123, filed on Mar. 6, 2009, now Pat. No. 8,146,758.

(60) Provisional application No. 61/068,374, filed on Mar. 7, 2008.

(51) Int. Cl.
*A61J 9/00* (2006.01)

(52) U.S. Cl.
CPC ..... *A61J 9/008* (2013.01)

(58) Field of Classification Search
CPC ..... A61J 9/008; B65D 81/32005; B65D 81/3211
USPC ..... 215/6, 11.1, 11.4; 206/219, 221
See application file for complete search history.

(56) References Cited

U.S. PATENT DOCUMENTS

| | | | | |
|---|---|---|---|---|
| 5,275,298 | A * | 1/1994 | Holley et al. | 215/11.4 |
| 5,277,303 | A * | 1/1994 | Goyet et al. | 206/221 |
| 5,564,600 | A * | 10/1996 | Renault | 222/129 |
| 6,474,861 | B1 * | 11/2002 | De Laforcade | 366/130 |
| 6,481,571 | B1 * | 11/2002 | Kelders et al. | 206/219 |
| 6,543,645 | B2 * | 4/2003 | Lacout | 222/129 |
| 7,523,822 | B2 * | 4/2009 | Sharon | 206/221 |
| 8,459,450 | B1 * | 6/2013 | Whitaker et al. | 206/219 |
| 2004/0089563 | A1 * | 5/2004 | Sharon et al. | 206/219 |
| 2007/0017890 | A1 * | 1/2007 | Al-Jadh | 215/11.1 |
| 2007/0199839 | A1 * | 8/2007 | Sharon et al. | 206/219 |
| 2007/0221601 | A1 * | 9/2007 | Eitrheim et al. | 215/6 |
| 2008/0142030 | A1 * | 6/2008 | Venere et al. | 132/116 |
| 2009/0178940 | A1 * | 7/2009 | Said | 206/221 |
| 2010/0163439 | A1 * | 7/2010 | Gutierrez Avendano | 206/219 |
| 2010/0300904 | A1 * | 12/2010 | Sharon | 206/222 |

FOREIGN PATENT DOCUMENTS

FR 2687640 A * 8/1993

* cited by examiner

*Primary Examiner* — Sue A Weaver

(57) ABSTRACT

A compartmentalized mixing bottle for storing and selectively introducing a soluble mix to a predetermined quantity of fluid is disclosed. Such a compartmentalized mixing bottle preferably includes a primary compartment having a plurality of primary conduits, a secondary compartment having a secondary conduit and spaced apart from the primary compartment. The compartmentalized mixing bottle further includes a mechanism for selectively isolating the primary compartment from the secondary compartment. Such a selectively isolating mechanism is in continuous fluid communication with the secondary conduit and is removably engaged with the primary and secondary compartments respectively. In this manner, bi-directional rotation (clockwise and counter clockwise) of at least a portion of the selectively isolating mechanism, relative to the primary compartment, isolates and fluidly communicates the primary compartment with the secondary compartment, respectively.

18 Claims, 11 Drawing Sheets

COMPARTMENTALIZED MIXING BOTTLE AND ASSOCIATED USE THEREFORE

CROSS REFERENCE TO RELATED APPLICATIONS

This application is a continuation-in-part application of U.S. patent application Ser. No. 12/381,123, filed Mar. 6, 2009, now U.S. Pat. No. 8,146,758 issued on Apr. 3, 2012, which claims the benefit of U.S. Provisional Application No. 61/068,374, filed Mar. 7, 2008, the entire disclosures of which are incorporated herein by reference in their entireties.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE DISCLOSURE

1. Technical Field

This disclosure relates to mixing bottles and, more particularly, to a compartmentalized mixing bottle for selectively introducing a granular or powder mix to a fluid contained in a primary compartment.

2. Prior Art

There are many circumstances which necessitate keeping ingredients separated in a container until they are ready to be mixed and dispensed. As an example, when using powdered mixing formula, it is necessary to mix the formula with water, thereby producing a milky liquid which is consumed by infants and small children. Once the formula is mixed, it must be consumed within a short period of time or refrigerated.

Typically, when traveling with an infant, feeding times are not precisely known and infants are fed on demand. The feeding time is normally indicated by urgent cries from the child and it is important not to delay. Many times, the infant will not eat if it is too upset. On the road, feeding a child using powdered formula can get complicated and messy as you have to measure the required amount of formula from a can and pour this into a mixing bottle containing water. Formula can be mixed ahead of time and stored in a portable insulated carrier but the formula should be consumed within two hours.

This time can be extended by placing an ice pack with the formula. Any time formula is refrigerated, it is usually necessary to heat it to at least room temperature before it is consumed. Even as the child develops and feeding times are easier to plan, it can be very difficult to feed the child while on the road. Considering the number of bottles a child consumes in a day, any apparatus designed to assist the parent in feeding should be easy to clean and relatively inexpensive. Obviously, it would be advantageous to provide a mixing bottle 10 that addresses all of these concerns.

Accordingly, the present disclosure is disclosed in order to overcome the above noted shortcomings. The compartmentalized mixing bottle is convenient and easy to use, lightweight yet durable in design, and designed for introducing a granular or powder mix to a fluid contained in a primary compartment. The assembly is simple to use, inexpensive, and designed for many years of repeated use.

BRIEF SUMMARY OF NON-LIMITING EXEMPLARY EMBODIMENT(S) OF THE PRESENT DISCLOSURE

In view of the foregoing background, it is therefore an object of the present disclosure to provide a compartmentalized mixing bottle and associated use therefore. These and other objects, features, and advantages of the disclosure are provided by a compartmentalized mixing bottle for storing and selectively introducing a soluble mix to a predetermined quantity of fluid. Such a compartmentalized mixing bottle preferably includes a primary compartment having a plurality of primary conduits, a secondary compartment having a secondary conduit and spaced apart from the primary compartment. The compartmentalized mixing bottle further includes a mechanism for selectively isolating the primary compartment from the secondary compartment. Such a selectively isolating mechanism is in continuous fluid communication with the secondary conduit and is removably engaged with the primary and secondary compartments respectively. In this manner, bi-directional rotation (clockwise and counter clockwise) of at least a portion of the selectively isolating mechanism, relative to the primary compartment, isolates and fluidly communicates the primary compartment with the secondary compartment, respectively.

In a non-limiting exemplary embodiment, the selectively isolating mechanism includes primary and secondary rings removably affixed to the primary and secondary compartments respectively, and a regulator simultaneously engaged with the primary and secondary compartments. Such a regulator is located within an interior of the primary and secondary rings and further is in continuous fluid communication with the secondary compartment. That is, rotation of at least one portion of the selectively isolating mechanism causes the regulator to linearly reciprocate along a bi-directional longitudinal path centrally passing through the primary and secondary rings.

In a non-limiting exemplary embodiment, the linear displacement of the regulator towards the primary ring decreases fluid communication between the primary and secondary compartments.

In a non-limiting exemplary embodiment, linear displacement of the regulator towards the secondary ring increases fluid communication between the primary and secondary compartments.

In a non-limiting exemplary embodiment, at least one portion of the selectively isolating mechanism includes one of the primary and secondary rings.

In a non-limiting exemplary embodiment, the secondary ring is rotatably abutted against the primary ring and maintains engagement with the primary ring such that the secondary ring is prohibited from disengaging the primary ring during rotation of at least one portion of the selectively isolating mechanism.

In a non-limiting exemplary embodiment, the primary ring includes a primary outer wall removably engaged with the primary compartment, and a primary inner wall provided with a curvilinear groove formed therein. That is, regulator is caused to slidably travel along the curvilinear groove when the secondary ring is rotated relative to the primary ring. Also, regulator is caused to linearly reciprocate towards and away from the secondary compartment, respectively, while the regulator travels along the curvilinear groove.

In a non-limiting exemplary embodiment, the secondary ring includes a secondary outer wall removably engaged with the secondary compartment, a secondary intermediate wall provided with a plurality of notches spaced therealong, and a secondary inner wall provided with a plurality of guide flanges radially extending inwards towards a center of the regulator.

In a non-limiting exemplary embodiment, the primary outer wall remains continuously abutted with the secondary outer wall during rotation of the selectively isolating mechanism.

In a non-limiting exemplary embodiment, the regulator maintains continuous contact with the guide flanges and thereby prohibits the secondary ring from swaying away from the longitudinal path during rotation of the at least one portion of the selectively isolating mechanism.

In a non-limiting exemplary embodiment, the regulator includes an exterior wall including a plurality of tongues radially protruding outwardly therefrom. Such tongues are interfitted within the curvilinear groove and travel in a curvilinear path as at least one portion of the selectively isolating mechanism is rotated.

In a non-limiting exemplary embodiment, the exterior wall of the regulator further includes a plurality of linear rails interfitted with the guide flanges. That is, linear rails are linearly displaced through the guide flanges when the tongues are slidably displaced along the curvilinear groove.

In a non-limiting exemplary embodiment, secondary ring maintains continuous rotatable engagement with primary ring as the linear rails are reciprocated through the guide flanges.

In a non-limiting exemplary embodiment, the regulator further includes a closed top end having a planar surface provided with an annular rim extending about an entire circumference thereof. Such a rim is releasably engaged with one of the primary conduits when the regulator is displaced a maximum distance away from secondary compartment. An open bottom end is in fluid communication with the closed top end, and an opening is formed in the exterior wall. Such an opening is intermediately situated between the closed top end and the open bottom end.

In a non-limiting exemplary embodiment, primary compartment includes a top nipple section removably connected to one of the primary conduits.

The present disclosure further includes a method of utilizing a compartmentalized mixing bottle for storing and selectively introducing a soluble mix to a predetermined quantity of fluid. Such a method includes the chronological steps of: providing a primary compartment having a plurality of primary conduits; providing a secondary compartment having a secondary conduit; spacing apart the secondary compartment from the primary compartment; providing a mechanism for selectively isolating the primary compartment from the secondary compartment; removably engaging the selectively isolating mechanism with the primary and secondary compartments respectively such that the selectively isolating mechanism is in continuous fluid communication with the secondary conduit; and bi-directionally rotating at least a portion of the selectively isolating mechanism relative to the primary compartment thereby respectively isolating and fluidly communicating the primary compartment with the secondary compartment.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of this disclosure are set forth with particularity in the appended claims. The disclosure itself, however, both as to its organization and method of operation, together with further objects and advantages thereof, may best be understood by reference to the following description taken in connection with the accompanying drawings in which:

Figure 1:
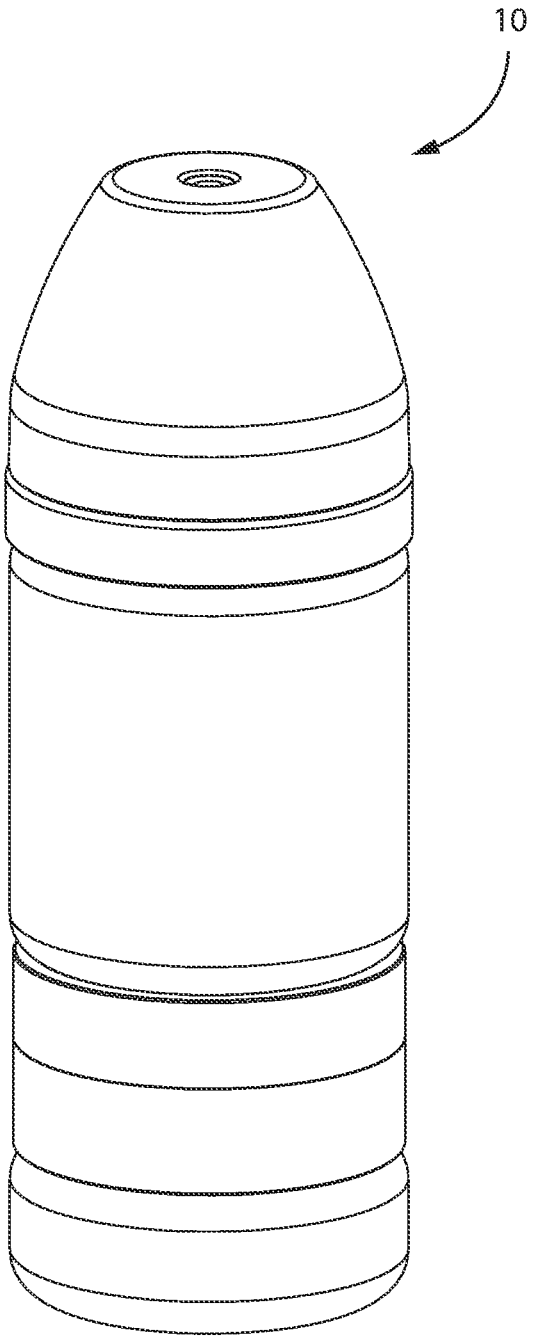
FIG. 1 is a perspective view of a compartmentalized mixing bottle, in accordance with an embodiment of the present disclosure.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment (s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment (s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment (s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

Figures 2, 2A:
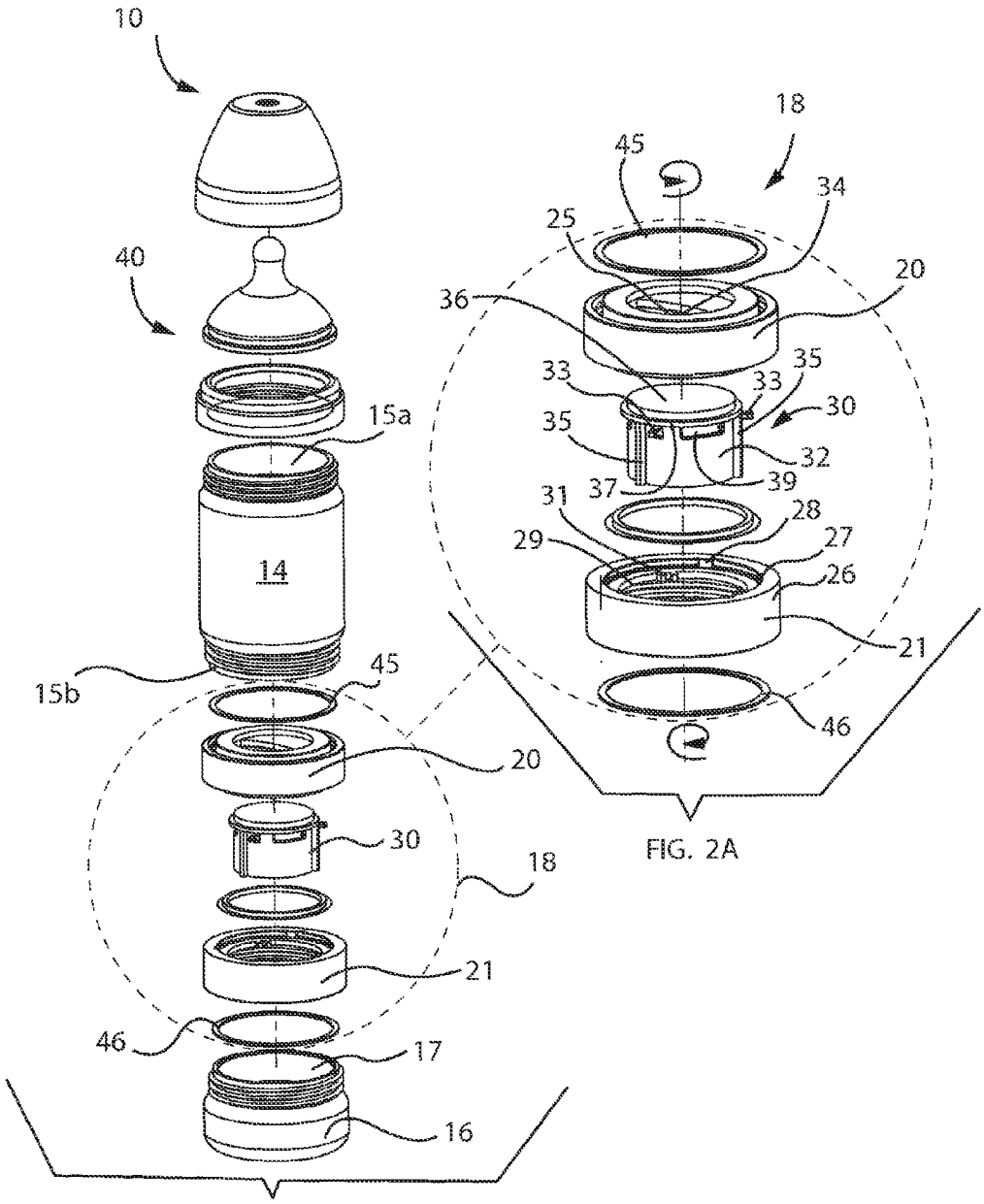
FIG. 2 is an exploded view of the compartmentalized mixing bottle shown in FIG. 1.
FIG. 2A is an enlarged view of section 2 circled in FIG. 2.
Figure 3:
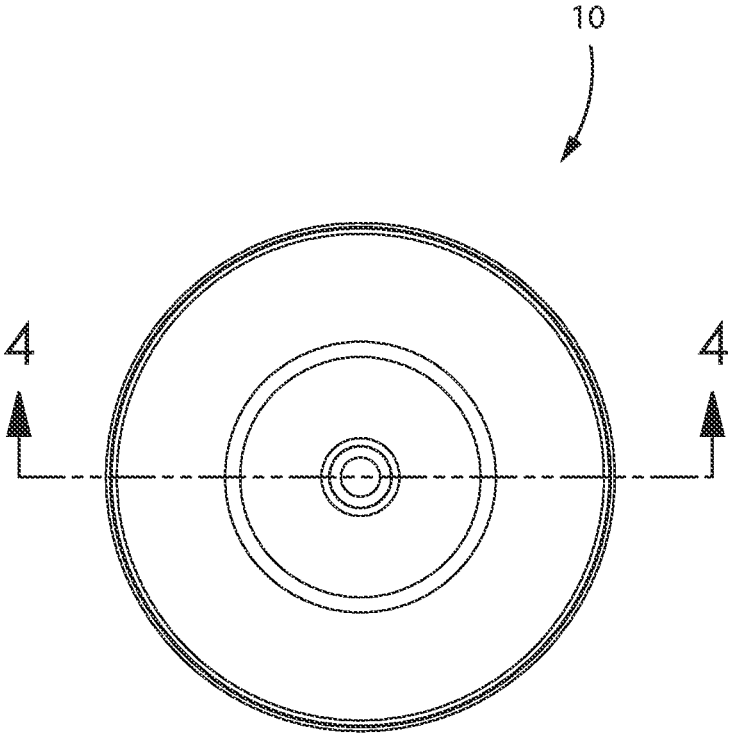
FIG. 3 is a top plan view of FIG. 1.
Figure 4:
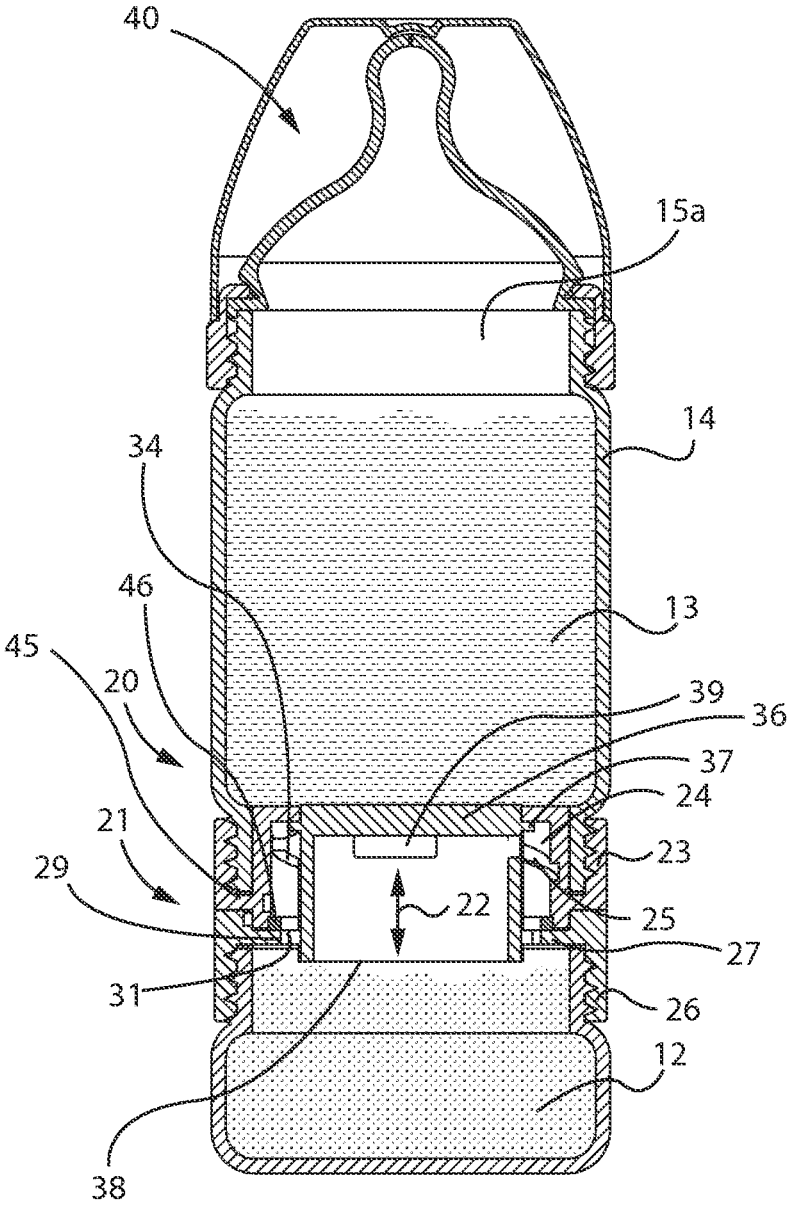
FIG. 4 is cross-sectional view of the compartmentalized mixing bottle taken along line 4-4.
Figure 5A:
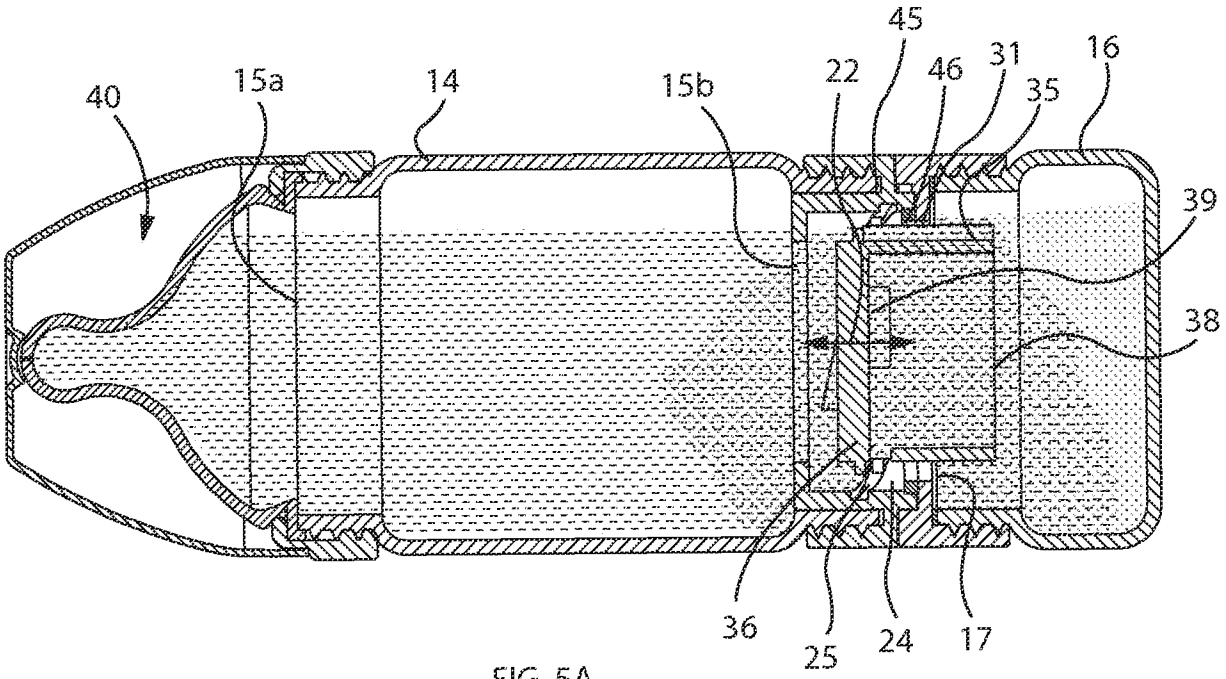
FIG. 5A is a cross-sectional showing the compartmentalized mixing bottle shaken along a horizontal (side-to-side) pattern.
Figure 5B:
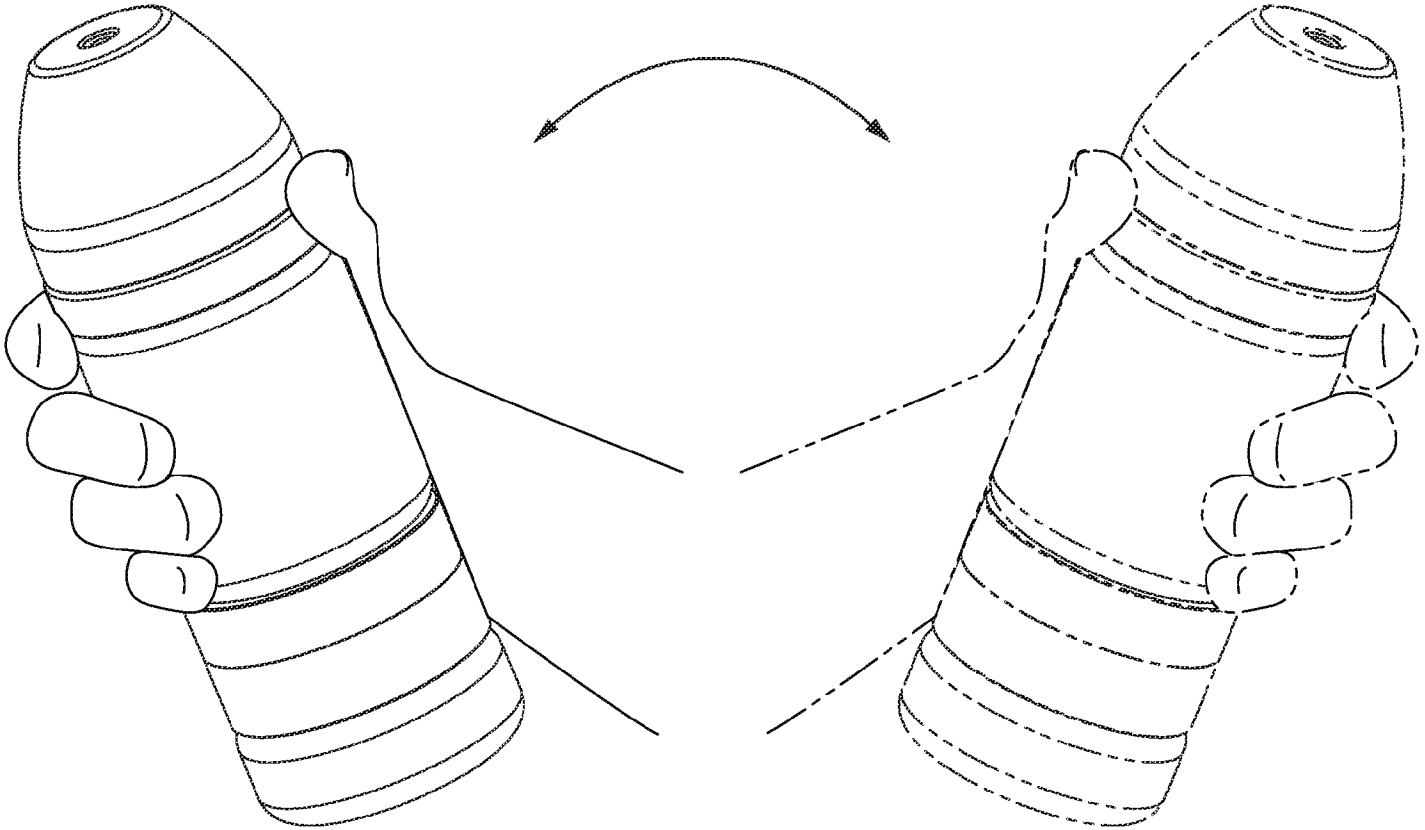
FIGS. 5B-5D illustrate the compartmentalized mixing bottle shaken in alternate directions.
Figure 5C:
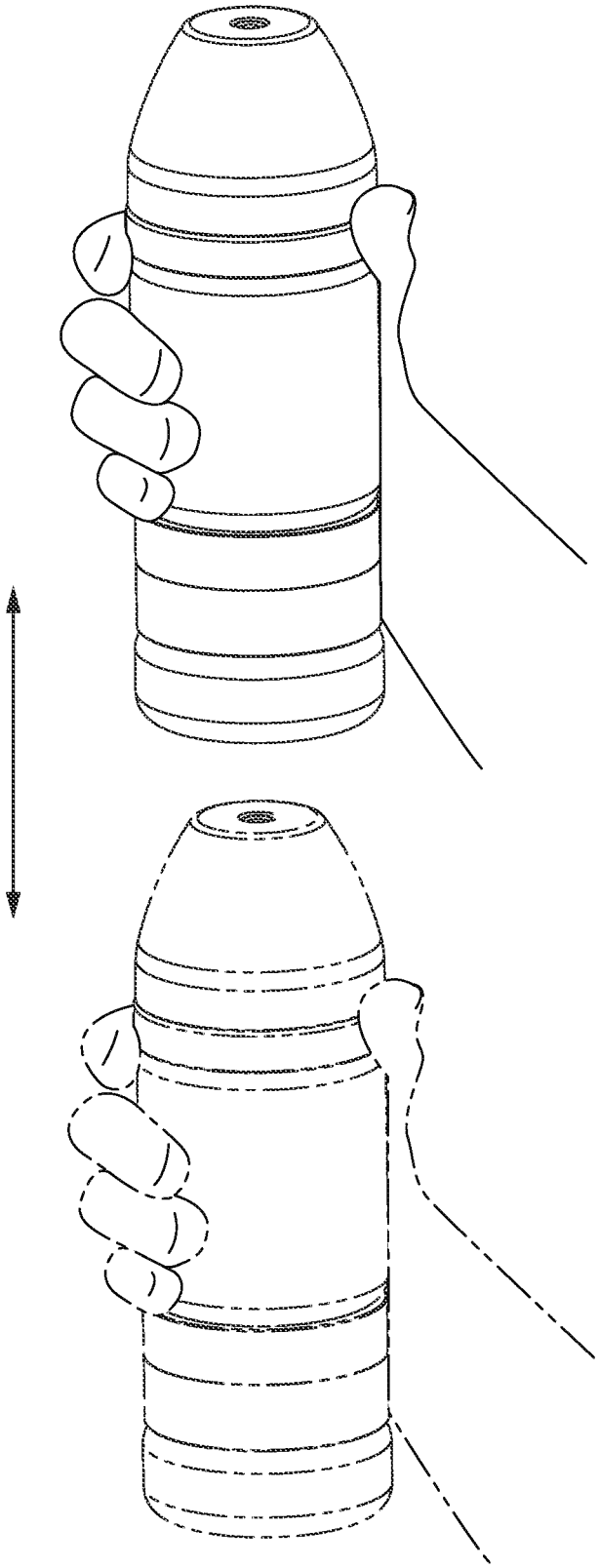
Figure 5D:
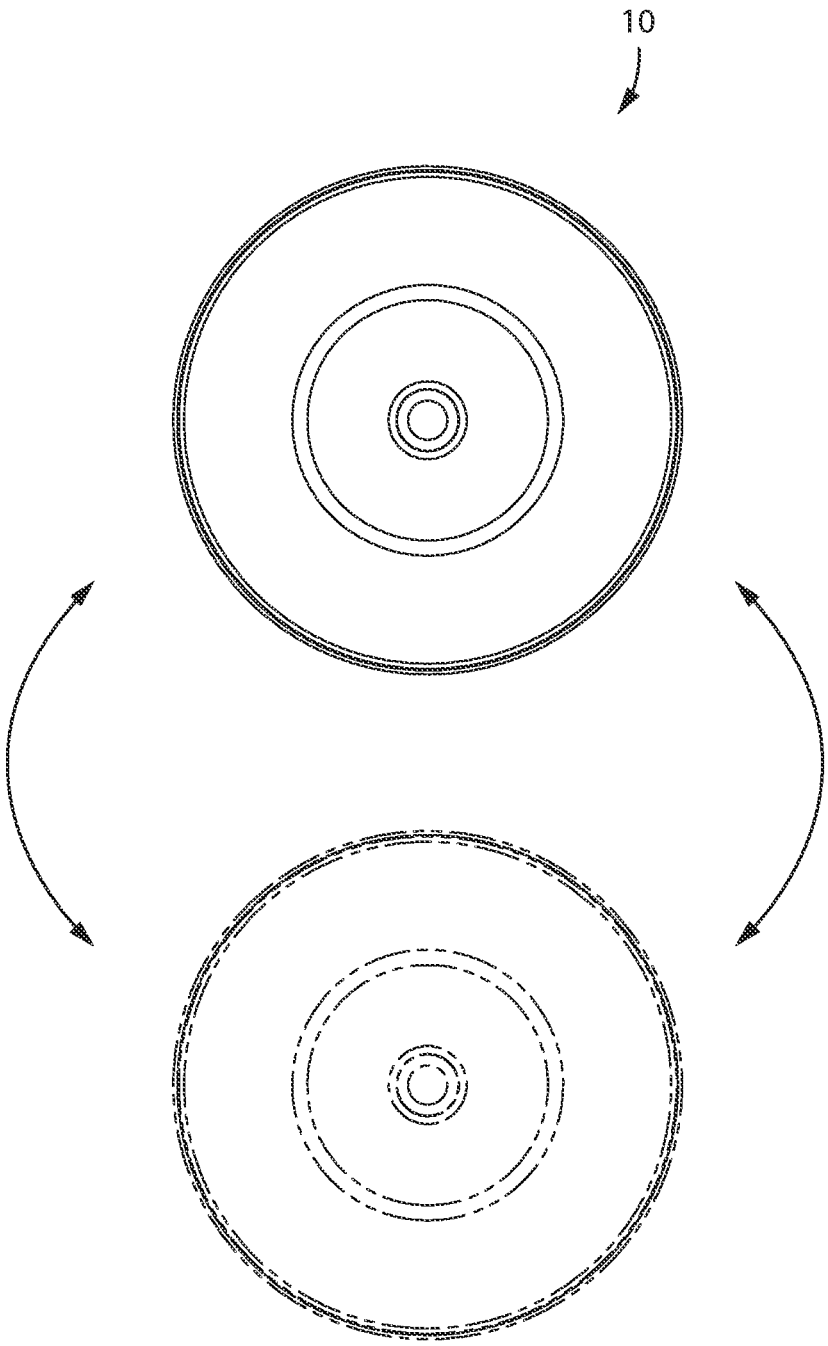
Figure 6A:
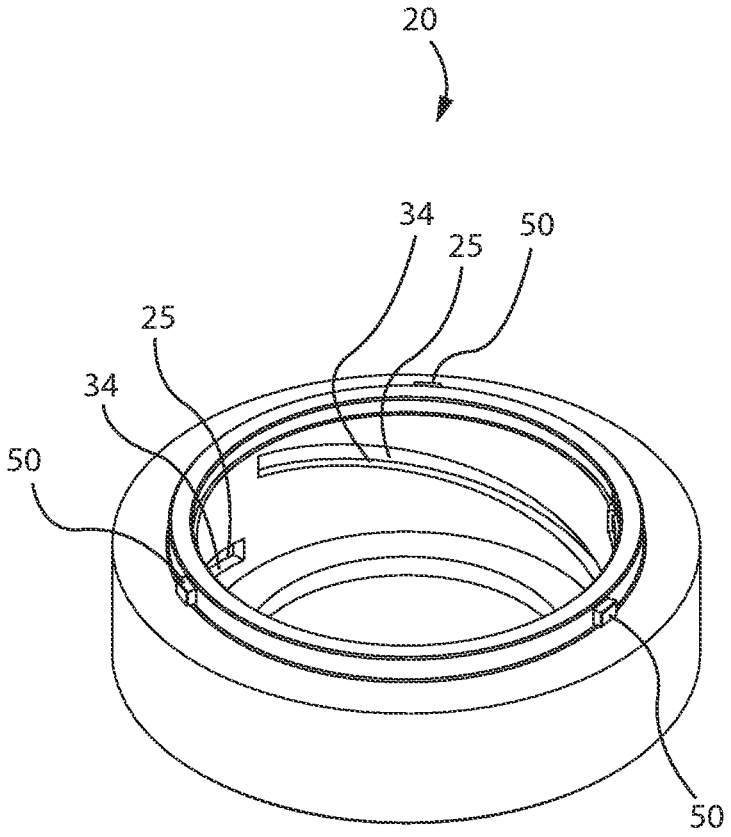
FIG. 6A is an enlarged and inverted perspective view of the primary ring showing the protrusions, curvilinear groove and curvilinear path.
Figure 6B:
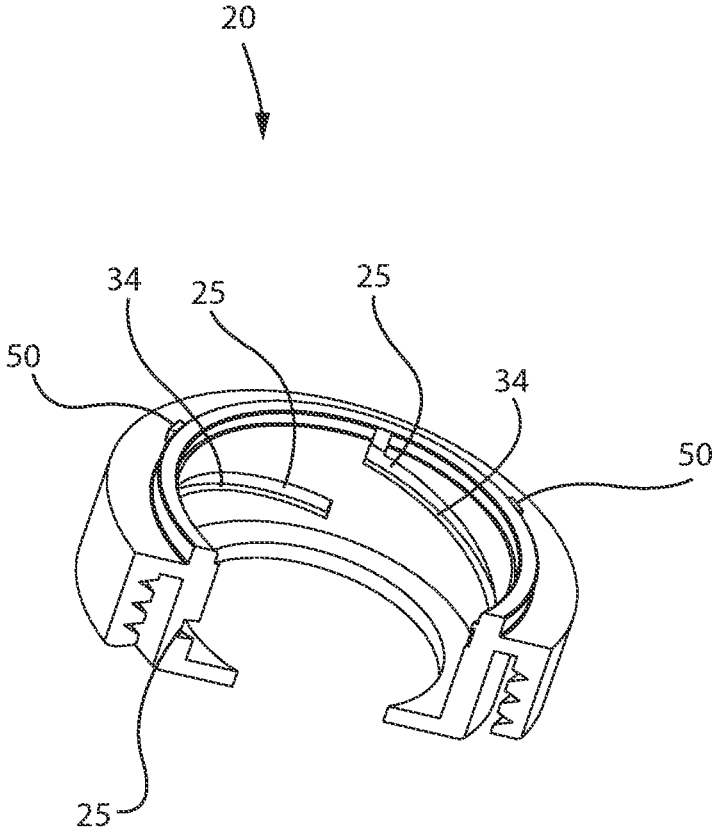
FIG. 6B is an exposed perspective view of the primary ring shown in FIG. 6A.
Figure 7:
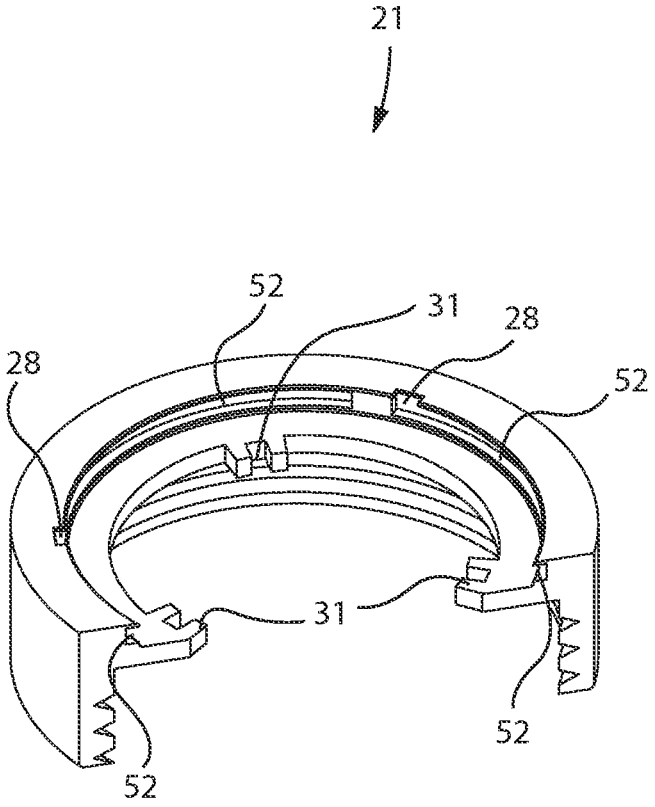
FIG. 7 is an enlarged and exposed perspective view of the secondary ring showing the notches, guide flanges and tracks.

The non-limiting exemplary embodiment(s) is/are referred to generally in FIGS. 1-7 and is/are intended to provide a compartmentalized mixing bottle 10 for storing and selectively introducing a soluble mix 12 to a predetermined quantity of fluid 13. It should be understood that such non-limiting exemplary embodiment(s) may be used to mix many different types of soluble mixes (e.g. powders, gels, etc.) with various types of fluids (e.g. water, alcohol, etc.) and should not be limited to the exemplary uses described herein.

Referring to FIGS. 1-7, a compartmentalized mixing bottle 10 is shown for storing and selectively introducing a soluble mix 12 to a predetermined quantity of fluid 13. Such a compartmentalized mixing bottle 10 preferably includes a primary compartment 14 having a plurality of primary conduits 15*a*, 15*b*, a secondary compartment 16, spaced apart from the primary compartment 14, and having a secondary conduit 17. The compartmentalized mixing bottle 10 further includes a mechanism 18 for selectively isolating the primary compartment 14 from the secondary compartment 16. Such a selectively isolating mechanism 18 is in continuous fluid communication with the secondary conduit 17 and is removably engaged with the primary and secondary compartments 14, 16, respectively. In this manner, bi-directional rotation (i.e., clockwise and counter clockwise) of at least a portion (i.e., primary and secondary rings 20, 21 explained hereinbelow) of the selectively isolating mechanism 18, relative to the primary compartment 14, isolates and fluidly communicates the primary compartment 14 with the secondary compartment 16, respectively. That is, rotation in a first direction facilitates isolation of the primary and secondary compartments 14, 16. Rotation in a second direction facilitates fluid communication between the primary and secondary compartments 14, 16. Such a structural configuration provides the unexpected and unpredictable advantage of enabling a user to rotatably bias at least one portion 14, 16 of bottle and thereby selectively adjust a degree of fluid communication (e.g., partially open, fully open, fully closed, etc.) so that the care giver can selectively permit mixture of the soluble mix 12 and fluid 13, as desired.

In a non-limiting exemplary embodiment, the selectively isolating mechanism 18 includes primary and secondary rings 20, 21 removably affixed to the primary and secondary compartments 14, 16, respectively. Notably, a regulator 30 is simultaneously engaged with the primary and secondary compartments 14, 16. Such a regulator 30 is located within an interior of the primary and secondary rings 20, 21 and further is in continuous fluid 13 communication with the secondary compartment 16. That is, rotation of at least one portion 14, 16 of the selectively isolating mechanism 18 causes the regulator 30 to linearly reciprocate along a bi-directional longitudinal path 22 centrally passing through the primary and secondary rings 20, 21. Such a structural configuration provides the unexpected and unpredictable advantage of enabling the caregiver to slowly mix the soluble mix 12 and fluid 13 in a controlled manner without having to completely dispense soluble mix 12 in fluid 13; thereby preventing formation of soluble mix 12 clumps that do not dissolve in the fluid 13.

In a non-limiting exemplary embodiment, linear displacement of the regulator 30—along longitudinal path 22—towards the primary ring 20 decreases fluid communication between the primary and secondary compartments 14, 16.

In a non-limiting exemplary embodiment, linear displacement of the regulator 30—along longitudinal path 22—towards the secondary ring 21 increases fluid communication between the primary and secondary compartments 14, 16.

In a non-limiting exemplary embodiment, at least one portion of the selectively isolating mechanism 18 includes one of the primary and secondary rings 20, 21.

In a non-limiting exemplary embodiment, the secondary ring 21 is rotatably abutted against the primary ring 20 and maintains engagement with the primary ring 20 such that the secondary ring 21 is prohibited from disengaging the primary ring 20 during rotation of at least one portion 20, 21 of the selectively isolating mechanism 18. That is, protrusions 50 extend radially outward from a bottom portion of primary ring 20 and are interfitted through notches 28 at secondary ring 21. Protrusions 50 are slidably displaced along track 52, which defines the rotational distance that primary and secondary rings 20, 21 rotate relative to each other. Such a structural configuration is important so that soluble mix 12 and fluid 13 do not undesirably leak out from primary and secondary rings 20, 21 during mixing procedures.

In a non-limiting exemplary embodiment, the primary ring 20 includes a primary outer wall 23 removably engaged with the primary compartment 14, and a primary inner wall 24 provided with a curvilinear groove 25 formed therein. That is, regulator 30 is caused to slidably travel along the curvilinear groove 25 when the secondary ring 21 is rotated relative to the primary ring 20. Also, regulator 30 is caused to linearly reciprocate towards and away from the secondary compartment 16—along longitudinal path 22 —, respectively, while the regulator 30 travels along the curvilinear groove 25.

In a non-limiting exemplary embodiment, the secondary ring 21 includes a secondary outer wall 26 removably engaged with the secondary compartment 16, a secondary intermediate wall 27 provided with a plurality of notches 28 spaced therealong, and a secondary inner wall 29 provided with a plurality of guide flanges 31 radially extending inwards towards a center of the regulator 30.

In a non-limiting exemplary embodiment, the primary outer wall 23 remains continuously abutted with the secondary outer wall 26 during rotation of the selectively isolating mechanism 18. Such a structural configuration ensures soluble mix 12 and fluid 13 do not undesirably exit from the selectively isolating mechanism 18.

In a non-limiting exemplary embodiment, the regulator 30 maintains continuous contact with the guide flanges 31 and thereby prohibits the secondary ring 21 from oscillating (swaying) away from longitudinal path 22 during rotation of at least one portion 20, 21 of the selectively isolating mechanism 18. A plurality of O-rings 45, 46 are frictionally engaged with primary and secondary rings 20, 21 for ensuring soluble mix 12 and fluid 13 do not prematurely escape therefrom.

In a non-limiting exemplary embodiment, the regulator 30 includes an exterior wall 32 including a plurality of tongues 33 radially protruding outwardly therefrom. Such tongues 33 are interfitted within the curvilinear groove 25 and travel in a curvilinear path 34 as at least one portion 20, 21 of the selectively isolating mechanism 18 is rotated.

In a non-limiting exemplary embodiment, the exterior wall 32 of regulator 30 further includes a plurality of linear rails 35 interfitted with the guide flanges 31. That is, linear rails 35 are linearly displaced through guide flanges 31 when the tongues 33 are slidably displaced along the curvilinear groove 25. Such displacement prohibits secondary ring 21 from swaying (oscillating) away from longitudinal path 22. Of course, contact between linear rails 35 and guide flanges 31 may be calibrated as needed to permit loose and/or tight linear displacement of regulator 30 towards secondary ring 16.

In a non-limiting exemplary embodiment, secondary ring 21 maintains continuous rotatable engagement with primary ring 20 as the linear rails 35 are reciprocated through the guide flanges 31.

In a non-limiting exemplary embodiment, the regulator 30 further includes a closed top end 36 having a planar surface provided with an annular rim 37 extending about an entire circumference thereof. Such a rim 37 is releasably engaged with one of the primary conduits 15*a*, 15*b* when regulator 30 is displaced a maximum distance—along longitudinal path 22—away from secondary compartment 16. An open bottom end 38 is in fluid communication with the closed top end 36, and an opening 39 is formed in the exterior wall 32. Such an opening 39 is intermediately situated between closed top end 36 and open bottom end 38. Such a structural configuration provides the unexpected and unpredictable advantage of enabling a user to remove the secondary compartment 16 and refill it with soluble mix 12 without having to empty fluid 13 contained within primary compartment 14.

In a non-limiting exemplary embodiment, primary compartment 14 includes a top nipple section 40 removably connected to one of the primary conduits 15*a*, 15*b*.

The present disclosure further includes a method of utilizing a compartmentalized mixing bottle 10 for storing and selectively introducing a soluble mix 12 to a predetermined quantity of fluid 13. Such a method includes the chronological steps of: providing a primary compartment 14 having a plurality of primary conduits 15*a*, 15*b*; providing a secondary compartment 16 having a secondary conduit 17; spacing apart the secondary compartment 16 from the primary compartment 14; providing a mechanism 18 for selectively isolating the primary compartment 14 from secondary compartment 16; removably engaging the selectively isolating mechanism 18 with primary and secondary compartments 14, 16, respectively, such that selectively isolating mechanism 18 is in continuous fluid communication with secondary conduit 17; and bi-directionally rotating at least a portion 14, 16 of selectively isolating mechanism 18 relative to the primary compartment 14 thereby respectively isolating and fluidly communicating primary compartment 14 with secondary compartment 16.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

While the disclosure has been described with respect to certain specific embodiments, it will be appreciated that many modifications and changes may be made by those skilled in the art without departing from the spirit of the disclosure. It is intended, therefore, by the appended claims to cover all such modifications and changes as fall within the true spirit and scope of the disclosure.

In particular, with respect to the above description, it is to be realized that the optimum dimensional relationships for the parts of the present disclosure may include variations in size, materials, shape, form, function and manner of operation. The assembly and use of the present disclosure are deemed readily apparent and obvious to one skilled in the art.

What is claimed as new and what is desired to secure by Letters Patent of the United States is:

1. A compartmentalized mixing bottle for storing and selectively introducing a soluble mix to a predetermined quantity of fluid, said compartmentalized mixing bottle comprising:

a primary compartment having a plurality of primary conduits;

a secondary compartment spaced apart from said primary compartment, said secondary compartment having a secondary conduit; and means for selectively isolating said primary compartment from said secondary compartment, said selectively isolating means being removably engaged with said primary and secondary compartments respectively;

wherein bi-directional rotation of at least a portion of said selectively isolating means, relative to said primary compartment, isolates and fluidly communicates said primary compartment with said secondary compartment respectively;

wherein said secondary compartment has a solid and continuous outer wall extending along an entire surface area thereof;

wherein said selectively isolating means comprises primary and secondary rings removably affixed to said primary and secondary compartments respectively, and a regulator simultaneously engaged with said primary and secondary compartments, said regulator being located within an interior of said primary and secondary rings and further being in continuous fluid communication with said secondary compartment;

wherein rotation of said at least one portion of said selectively isolating means causes said regulator to linearly reciprocate along a bi-directional longitudinal path centrally passing through said primary and secondary rings.

2. The compartmentalized mixing bottle of claim 1, wherein linear displacement of said regulator towards said primary ring decreases fluid communication between said primary and secondary compartments.

3. The compartmentalized mixing bottle of claim 1, wherein linear displacement of said regulator towards said secondary ring increases fluid communication between said primary and secondary compartments.

4. The compartmentalized mixing bottle of claim 1, wherein said at least one portion of said selectively isolating means comprises: one of said primary and secondary rings.

5. The compartmentalized mixing bottle of claim 1, wherein said secondary ring is rotatably abutted against said primary ring and maintains engagement with said primary ring such that said secondary ring is prohibited from oscillating away from a bi-directional longitudinal path during rotation of said at least one portion of said selectively isolating means.

6. The compartmentalized mixing bottle of claim 1, wherein said primary ring comprises:

a primary outer wall removably engaged with said primary compartment; and a primary inner wall provided with a curvilinear groove formed therein, said regulator being caused to slidably travel along said curvilinear groove when said secondary ring is rotated relative to said primary ring;

wherein said regulator is caused to linearly reciprocate towards and away from said secondary compartment, respectively, while said regulator travels along said curvilinear groove.

7. The compartmentalized mixing bottle of claim 6, wherein said secondary ring comprises:

a secondary outer wall removably engaged with said secondary compartment;

a secondary intermediate wall provided with a plurality of notches spaced therealong; and a secondary inner wall provided with a plurality of guide flanges radially extending inwards towards a center of said regulator.

8. The compartmentalized mixing bottle of claim 7, wherein said primary outer wall remains continuously abutted with said secondary outer wall during rotation of said selectively isolating means.

9. The compartmentalized mixing bottle of claim 8, wherein said regulator maintains continuous contact with said guide flanges and thereby prohibits said secondary ring from swaying away from the longitudinal path during rotation of said at least one portion of said selectively isolating means.

10. The compartmentalized mixing bottle of claim 7, wherein said regulator comprises:

an exterior wall including a plurality of tongues radially protruding outwardly therefrom, said tongues being interfitted within said curvilinear groove and traveling in a curvilinear path as said at least one portion of said selectively isolating means is rotated.

11. The compartmentalized mixing bottle of claim 10, wherein said exterior wall of said regulator further includes a plurality of linear rails interfitted with said guide flanges, said linear rails being linearly displaced through said guide flanges when said tongues are slidably displaced along said curvilinear groove.

12. The compartmentalized mixing bottle of claim 11, wherein said secondary ring maintains continuous rotatable engagement with said primary ring as said linear rails are reciprocated through said guide flanges.

13. The compartmentalized mixing bottle of claim 11, wherein said regulator further comprises:

a closed top end having a planar surface provided with an annular rim extending about an entire circumference thereof, said rim being releasably engaged with one of said primary conduits when said regulator is displaced a maximum distance away from secondary compartment;

an open bottom end in fluid communication with said closed top end; and an opening formed in said exterior wall and being intermediately situated between said closed top end and said open bottom end.

14. The compartmentalized mixing bottle of claim 1, wherein said primary compartment comprises: a top nipple section removably connected to one of said primary conduits.

15. A compartmentalized mixing bottle for storing and selectively introducing a soluble mix to a predetermined quantity of fluid, said compartmentalized mixing bottle comprising:

a primary compartment having a plurality of primary conduits;

a secondary compartment spaced apart from said primary compartment, said secondary compartment having a secondary conduit; and means for selectively isolating said primary compartment from said secondary compartment, said selectively isolating means being removably engaged with said primary and secondary compartments respectively;

wherein bi-directional rotation of at least a portion of said selectively isolating means, relative to said primary compartment, isolates and fluidly communicates said primary compartment with said secondary compartment respectively;

wherein said selectively isolating means is in continuous fluid communication with said secondary conduit;

wherein said selectively isolating means comprises primary and secondary rings removably affixed to said primary and secondary compartments respectively, and a regulator simultaneously engaged with said primary and secondary compartments, said regulator being located within an interior of said primary and secondary rings and further being in continuous fluid communication with said secondary compartment;

wherein rotation of said at least one portion of said selectively isolating means causes said regulator to linearly reciprocate along a bi-directional longitudinal path centrally passing through said primary and secondary rings.

16. The compartmentalized mixing bottle of claim 15, wherein linear displacement of said regulator towards said primary ring decreases fluid communication between said primary and secondary compartments.

17. The compartmentalized mixing bottle of claim 15, wherein linear displacement of said regulator towards said secondary ring increases fluid communication between said primary and secondary compartments.

18. A method of utilizing a compartmentalized mixing bottle for storing and selectively introducing a soluble mix to a predetermined quantity of fluid, said method comprising the chronological steps of:

providing a primary compartment having a plurality of primary conduits;

providing a secondary compartment having a secondary conduit;

spacing apart said secondary compartment from said primary compartment;

providing a mechanism for selectively isolating said primary compartment from said secondary compartment;

removably engaging said selectively isolating mechanism with said primary and secondary compartments respectively such that said selectively isolating mechanism is in continuous fluid communication with said secondary conduit; and bi-directionally rotating at least a portion of said selectively isolating mechanism relative to said primary compartment thereby respectively isolating and fluidly communicating said primary compartment with said secondary compartment;

wherein said selectively isolating means comprises primary and secondary rings removably affixed to said primary and secondary compartments respectively, and a regulator simultaneously engaged with said primary and secondary compartments, said regulator being located within an interior of said primary and secondary rings and further being in continuous fluid communication with said secondary compartment;

wherein rotation of said at least one portion of said selectively isolating means causes said regulator to linearly reciprocate along a bi-directional longitudinal path centrally passing through said primary and secondary rings.

* * * * *